US005882140A

United States Patent [19]

Yodock, Jr. et al.

[11] Patent Number: 5,882,140

[45] Date of Patent: Mar. 16, 1999

[54] BARRIER DEVICE

[76] Inventors: Leo J. Yodock, Jr.; Leo J. Yodock, III, both of 750 S. Park Rd., Suite 8-215, Hollywood, Fla. 33021; Steven J. Yodock, 309 Krokus Ter., Apt. 1, Hollywood, Fla. 33019

[21] Appl. No.: 790,838

[22] Filed: Jan. 30, 1997

[51] Int. Cl.[6] ..... E01F 13/00

[52] U.S. Cl. ..... 404/6; 256/13.1

[58] Field of Search ..... 404/6–9; 256/13.1; 52/586.1, 586.2, 720.1, 721.1, 729.1

[56] References Cited

U.S. PATENT DOCUMENTS

| | | | |
|---|---|---|---|
| 4,059,362 | 11/1977 | Smith | 404/6 |
| 4,391,077 | 7/1983 | Giess | 52/586.2 X |
| 4,681,302 | 7/1987 | Thompson | 256/13.1 |
| 4,773,629 | 9/1988 | Yodock | 256/13.1 |
| 4,946,306 | 8/1990 | Yodock | 404/6 |
| 5,123,773 | 6/1992 | Yodock | 404/6 |
| 5,498,101 | 3/1996 | Braverman | 404/6 |
| 5,531,540 | 7/1996 | Wasserstrom et al. | 404/6 |
| 5,605,413 | 2/1997 | Brown | 404/6 |

*Primary Examiner*—Tamara L. Graysay
*Assistant Examiner*—Sunil Singh
*Attorney, Agent, or Firm*—Holland & Knight LLP

[57] ABSTRACT

A barrier device comprising a top wall, a bottom wall, opposed end walls, and, opposed sidewalls each including an elongated, vertically extending curb reveal connected to the bottom wall, a substantially vertically extending upper section connected to the top wall, an angled intermediate section connected at one end to the upper section, and, a substantially horizontally extending step connected between the other end of the intermediate section and the curb reveal. Each wall is formed of a resilient plastic, and the walls are interconnected to define a hollow interior which can be filled with a ballast material such as water, sand, rubber, concrete and the like.

15 Claims, 4 Drawing Sheets

BARRIER DEVICE

FIELD OF THE INVENTION

This invention relates to barrier devices for traffic control, soil erosion containment, impact attenuation and the like, and, more particularly, to barrier devices formed of a light weight plastic having a hollow interior fillable with a ballast material such as water, sand, concrete, rubber and the like which can be interconnected with one another to define a continuous barrier structure and/or connected in various combinations to form energy-absorbing cells.

BACKGROUND OF THE INVENTION

A variety of different devices have been developed for absorbing the kinetic energy of impact of colliding automobiles, and for the containment of forces exerted by soil or water. Highway barrier devices, for example, are intended to provide a continuous wall or barrier along the center line of a highway when laid end-to-end to absorb grazing blows from moving vehicles. One commonly used highway barrier is formed of precast reinforced concrete, and is known as the "New Jersey" style barrier. Highway barriers of this type have a relatively wide base including sidewalls which extend vertically upwardly from the pavement a short distance, then angle inwardly and upwardly to a vertically extending top portion connected to the top wall of the barrier. This design is intended to contact and redirect the wheels of a vehicle in a direction toward the lane of traffic in which the vehicle was originally traveling, instead of the lane of opposing traffic. See U.S. Pat. No. 4,059,362.

One problem with highway barriers of the type described above is the high weight of reinforced concrete. A barrier having a typical length of twelve feet weighs about 2,800–3,200 pounds and requires special equipment to load, unload and handle on site. It has been estimated that for some road repairs, up to 40 percent of the total cost is expended on acquiring, delivering and handling concrete barriers. Additionally, concrete barriers have little or no ability to absorb shock upon impact, and have a high friction factor. This increases the damage to vehicles which collide with such barriers, and can lead to serious injuries to passengers of the vehicle.

In an effort to reduce weight, facilitate handling and shipment, and provide improved absorption of impact forces, highway barriers have been designed which are formed of a hollow plastic container filled with water, sand or other ballast material such as disclosed in U.S. Pat. Nos. 4,681,302; 4,773,629; 4,846,306 and 5,123,773. For example, the '302 patent discloses a barrier comprising a container having a hollow interior filled with water, and having fittings for coupling one barrier to another to form a continuous wall. The container structure is formed of a resilient material which is deformable upon impact and capable of resuming its original shape after being struck. Longitudinally extending, spaced traction spoiler channels are said to reduce the area of potential impact and thus the tendency of the vehicle to climb the walls of the barrier and vault over it into the opposing lane of traffic.

The '629, '306 and '773 patents noted above were invented by the present inventor and represent further advances in deformable highway barrier designs. The first two patents disclose barriers which comprise a longitudinally extending container made of semi-rigid plastic which is self-supporting, and has a predetermined shape which is maintained when filled with water, sand or other ballast material. Such devices are connected end-to-end by a key insertable within grooves formed in the end walls of adjacent barriers. Interconnected fill openings are provided which permit adjacent barriers to be filled with water or the like when laid end-to-end.

The '773 patent discloses an improved barrier having sidewalls formed with vertical indentations in order to assist in maintaining the structural integrity of the container, and to create internal baffles for dampening movement of water or other fluid within the container interior. Interlocking male and female coupling elements are formed on opposite end walls of the barrier to facilitate end-to-end connection thereof. Additionally, the base of such barrier is formed with channels to permit the insertion of the tines of a fork lift truck therein for handling of the barrier, and these channels also provide for drainage of water and the like along the ground from one side of the barrier to the other.

Despite the improvements in highway barrier designs noted above, problems nevertheless remain, particularly in controlling the tendency of a vehicle which strikes the barrier to "ride up" or move vertically upwardly along the barrier sidewall toward the opposite lane of traffic. Additionally, the means conventionally employed for interconnecting adjacent, deformable barriers may not be adequate in certain instances, and can result in separation of adjacent barriers particularly upon impact with relatively large and heavy vehicles.

SUMMARY OF THE INVENTION

It is therefore among the objectives of this invention to provide a barrier device for use as a highway barrier or other energy absorbing structure which is easily transported and handled, which resists upward movement of a vehicle or other object therealong upon impact, which resists separation when laid end-to-end, which can be permanently positioned at a particular location, and, which is economical to purchase and install.

These objectives are accomplished in a barrier device comprising a top wall, a bottom wall, opposed end walls, and, opposed sidewalls each including an elongated, vertically extending curb reveal connected to the bottom wall, a substantially vertically extending upper section connected to the top wall, an angled intermediate section connected at one end to the upper section, and, a substantially horizontally extending step connected between the other end of the intermediate section and the curb reveal. Each wall is formed of a resilient plastic, and the walls are interconnected to collectively define a hollow interior which can be filled with a ballast material such as water, sand, rubber, concrete and the like.

One aspect of this invention is predicated upon the concept of reducing the tendency of the tires of a vehicle to ride up along the sidewall of the barrier upon impact, which could result in the vehicle vaulting over the barrier to the opposing lane of traffic. This is achieved with several features of the barrier design herein. First, the curb reveal is preferably about nine inches in vertical height measured from the bottom wall of the barrier, appreciably higher than prior designs, which assists in redirecting the tires of a vehicle upon impact therewith back toward the lane in which the vehicle was originally traveling. The horizontally oriented step extending between the curb reveal and the angled intermediate section of the barrier sidewall adds strength and reinforcement to the curb reveal to maximize its ability to redirect the path of vehicle tires.

The angulation and construction of the intermediate section of the barrier sidewall also assists in resisting upward movement of vehicles therealong. Upon impact with the tires and/or bumper of a vehicle, the intermediate section deforms or buckles inwardly, toward the interior of the barrier, creating essentially a pivot point about which the upper section of the barrier sidewall can move. The upper section pivots or buckles in a generally downward direction, toward the bottom wall of the barrier, and into engagement with the tires and/or bumper of the vehicle which has impacted the barrier. This tends to force the vehicle in a downward direction, back onto the pavement, instead of over the top wall of the barrier. As such, the overall objective of keeping the vehicle in its own lane of traffic instead of the opposing lane is achieved by the barrier of this invention.

Another aspect of this invention is directed to structure for maintaining the adjacent barriers interconnected with one another, and, if desired, in a permanent position with respect to the surface on which the barriers are placed. This is obtained with several structural features of the barriers herein.

In the presently preferred embodiment, the intermediate section of each sidewall is formed with a number of stabilizers, each including a base and a pair of opposed sides. A throughbore is formed in the barrier extending from the base of each stabilizer and through the bottom wall. At least one of these throughbores receives a stake or other anchoring device insertable into the ground or other surface upon which the barrier rests in order to maintain the barrier in a fixed position thereon. Preferably, the base of each stabilizer is co-planar with the step in the barrier sidewall to provide additional overall strength to the sidewall and the curb reveal.

With respect to the structure for interconnecting adjacent barriers, each end wall is formed with a slot which is alignable with the slot of another barrier. When placed end-to-end, the slots of adjacent barriers collectively define a locking channel which receives a coupler extending therebetween to interconnect the two barriers together. The locking channel and coupler are generally shaped like a barbell having cylindrical ends which permit pivotal movement of one barrier device relative to adjacent ones. Additionally, a pair of hollow sleeves are located within the barrier interior which extend horizontally between the opposed sidewalls. A strap is extended between the sleeve of one barrier, and the sleeve of an adjacent barrier, and then tightened down to urge the barriers together and provide additional resistance to separation of adjacent barriers in the event of an impact. Lastly, one of the opposed end walls of each barrier is formed with a recess and the other with a mating extension so that when connected end-to-end the extension of one end wall is inserted into the recess of an adjacent end wall for further resistance to disengagement or lateral displacement.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE PREFERRED EMBODIMENT

Figure 1:
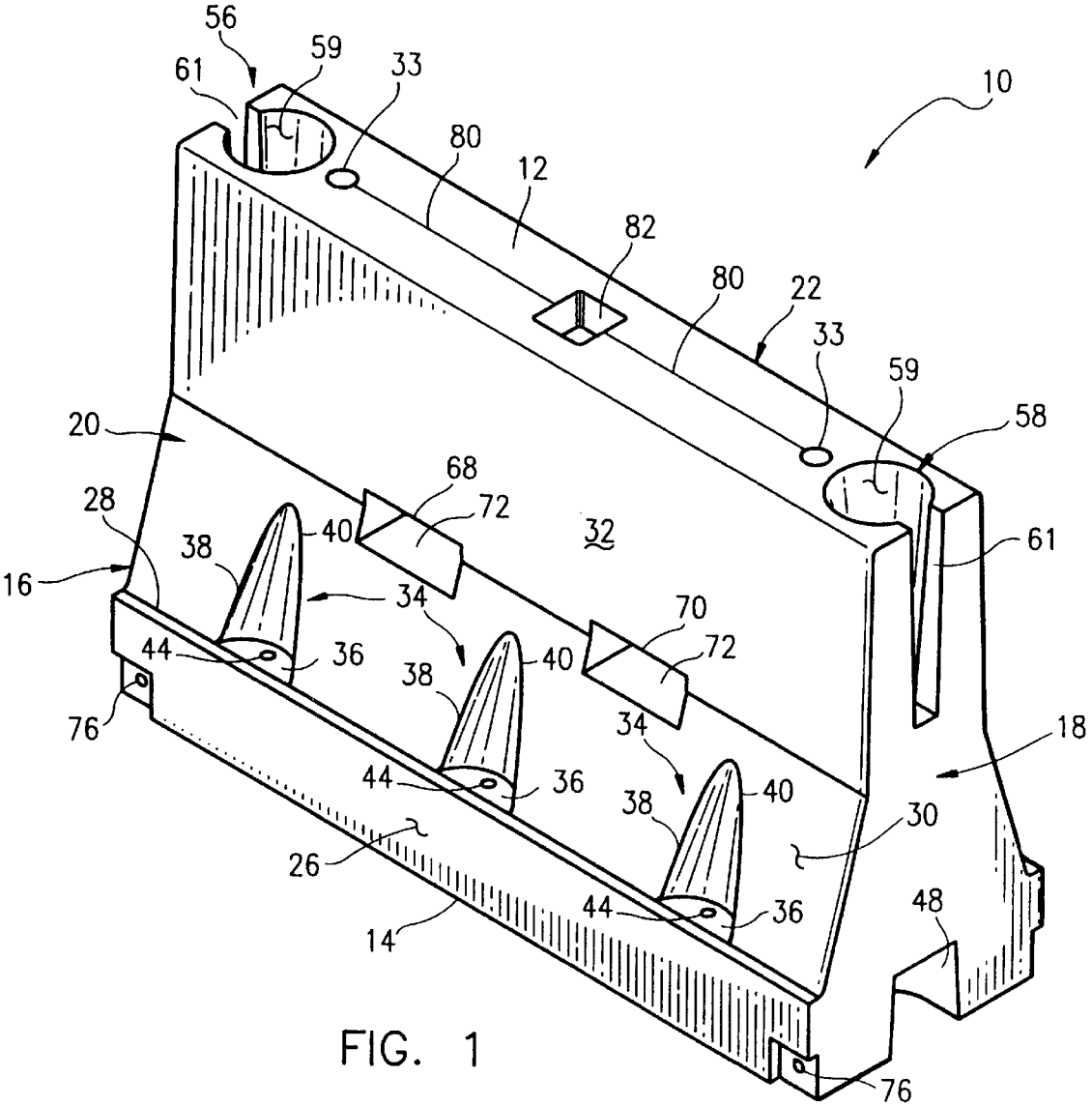
FIG. 1 is a perspective view of the barrier of this invention.

Referring now to the Figs., the barrier device 10 of this invention comprises a top wall 12, a bottom wall 14, opposed end walls 16, 18, and, opposed sidewalls 20, 22 which are interconnected to collectively define a hollow interior 24. In the presently preferred embodiment, each of the walls 12–22 are formed of a semi-rigid plastic material chosen from the group consisting of low density polyethylene, acrylonitrile or butadiene styrene, high impact styrene, polycarbonates and the like. These plastic materials are all inherently tough and exhibit good energy absorption characteristics. They will also deform and elongate, but will not fail in a brittle manner at energy inputs which cause other materials to undergo brittle failure. The surfaces of these types of plastic materials are inherently smoother than materials from which other barriers are typically constructed, therefore creating less friction and reducing the likelihood of serious abrasion injuries to vehicles and/or passengers who may come into contact therewith. Additionally, materials of this type are unaffected by weather and have excellent basic resistance to weathering, leaching and biodegradation. Additives such as ultraviolet inhibitors can be added thereto, making such materials further resistant to the effects of weather. They also retain their mechanical and chemical properties at low ambient temperatures.

When using the barrier device 10 of this invention as a highway barrier, the hollow interior 24 is preferably filled with a "ballast" material such as water or other liquid, or a flowable solid material such as sand, concrete and the like. For this purpose, the walls 12–22 of barrier device 10 have a thickness in the range of about one-eighth inch to one inch so as to perform satisfactorily in service. The barrier device 10 is preferably in the range of about six to eight feet in length, and, at the wall thickness noted above, has a weight when empty of about 80 to 140 lbs. When filled with a liquid such as water, the overall weight of the barrier is in the range of about 1400 to 2200 lbs. Flowable solid material such as sand and the like increase the weight of barrier 10 further.

For ease of understanding and discussion of the principal aspects of this invention, the various structural elements of the barrier device 10 are described below in relation to their collective performance of a particular function of the barrier 10. As noted above, these functions include the ability of the barrier 10 to better redirect and control the upper movement of a vehicle upon impact therewith, and, the ability to resist lateral separation of adjacent barriers 10 when they are joined end-to-end to form an essentially continuous wall or when they are arranged.

Control of Vehicle Movement

The control of vehicle movement upon impact with the barrier device 10 of this invention is achieved primarily by the material with which the barrier 10 is constructed, and the configuration of its sidewalls 20 and 22. Because both sidewalls 20, 22 are identical in configuration, only sidewall 20 is described in detail herein, it being understood that the sidewall 22 is formed with the identical structure and functions in the same manner.

The sidewall 20 includes a substantially vertically extending curb reveal 26 which extends from the bottom wall 14 to a horizontally extending ledge or step 28 best shown in FIG. 1. Preferably, the curb reveal 26 has a vertical height of nine inches, measured from the bottom wall 14 upwardly, which is at least two inches greater than the curb reveals of other highway barrier devices, such as disclosed, for example, in my prior U.S. Pat. No. 5,123,773. The horizontal extent of the step 28 is preferably on the order of about 1½inches measured in the direction from the outer edge of curb reveal 26 toward the hollow interior 24 of barrier device 10.

Figure 3:
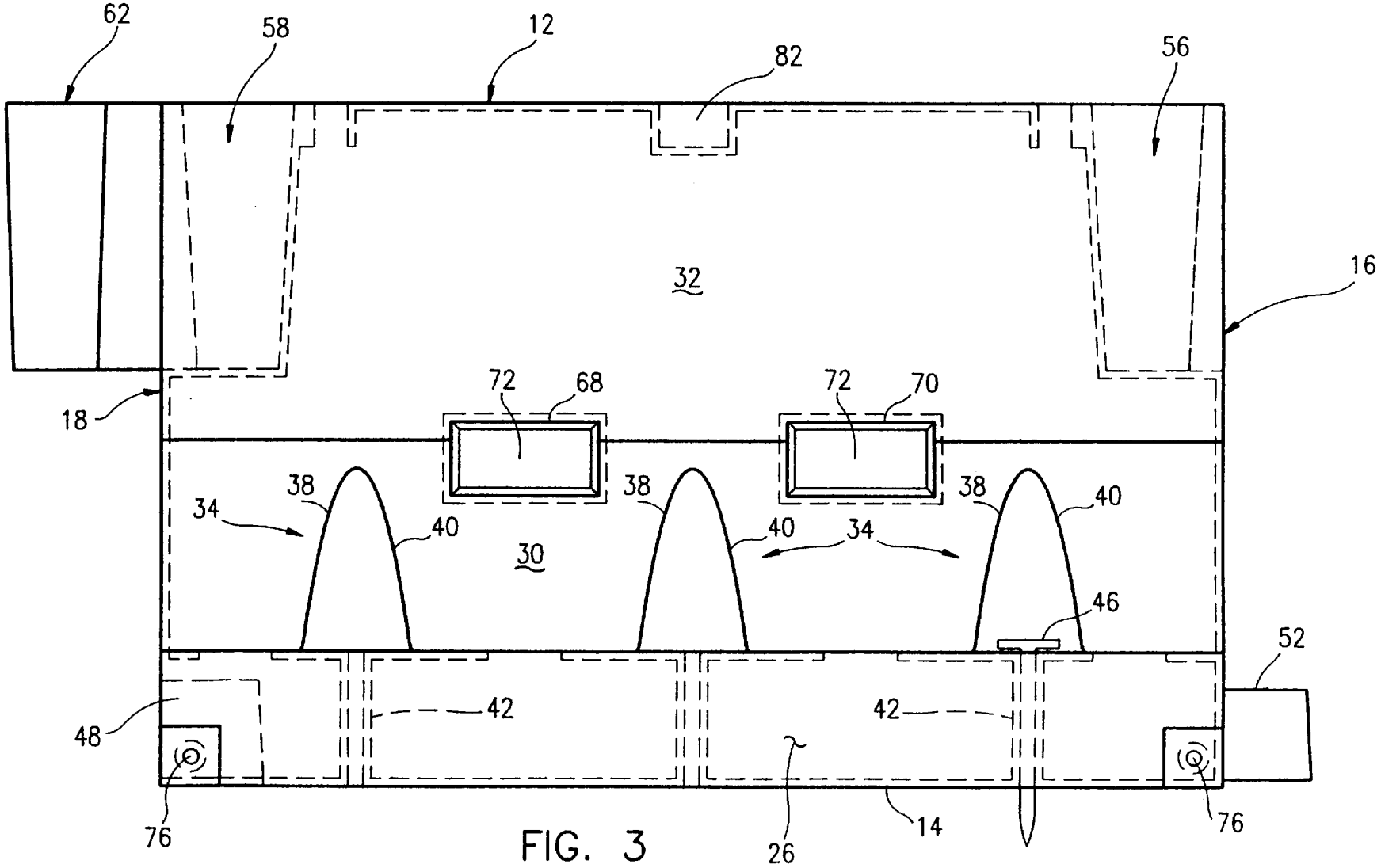
FIG. 3 is a side view of the barrier of FIG. 1.

Extending upwardly at an acute angle from the step 28 is an intermediate section 30 which terminates at a vertically extending upper section 32. The upper section 32, in turn, extends from the intermediate section 30 to the top wall 12 of barrier 10 which is formed with a pair of fill holes 33 preferably having a diameter in the range of about 3–4 inches. In the presently preferred embodiment, a number of stabilizers 34 are integrally formed in the intermediate section 30, at regularly spaced intervals between the end walls 16, 18. Each stabilizer 34 includes a base 36 and opposed sides 38 and 40. As best seen in FIG. 1, the base 36 of each stabilizer 34 is coplanar with the step 28 and is supported by an internally located support 42 shown in phantom lines in FIG. 3. The sides 38, 40 of each stabilizer 34 taper inwardly, toward one another, from the base 36 to a point substantially coincident with the uppermost edge of intermediate section 30 where the upper section 32 of sidewall 20 begins. In the presently preferred embodiment, a throughbore 44 extends from the base 36 of one or more of the stabilizers 34, through the internal support 42 and out the bottom wall 14 of barrier 10. One or more of these throughbores 44 receive an anchoring device such as a stake 46, shown in phantom in FIG. 3, which can be driven into the ground or other surface upon which the barrier device 10 rests to secure it in an essentially permanent position thereon.

Enhanced control and redirection of the path of a vehicle impacting the barrier device 10 of this invention is achieved with the above-described structure as follows. The increased height of the curb reveal 26 of sidewall 20, e.g., nine inches compared to seven inches or less for conventional barriers, is effective to engage and redirect the tires of a vehicle toward the lane in which the vehicle was traveling instead of in a direction toward the barrier 10 or the opposing lane of traffic. The curb reveal 26 is strengthened and reinforced by the presence of the horizontally extending ledge or step 28 and the stabilizers 34.

In the event the vehicle tires nevertheless extend above the curb reveal 26 upon impact, the intermediate and upper sections 30 and 32 are designed to resist farther upward movement of the vehicle therealong. While the stabilizers 34 in intermediate section 30 function to add rigidity and stability to the overall barrier 10, the intermediate section 30 is nevertheless designed to at least partially collapse inwardly or buckle in response to the application of an impact force thereto. The extent of inward motion of buckling is controlled, at least to some extent, by the diameter of the fill holes 33 in the top wall 12. When the barrier interior 24 is filled with water, for example, the impact of a vehicle with a barrier sidewall 20 or 22 causes such water to displace from the area of contact. Some of the water is forcefully discharged from the interior 24 through the fill holes 33, and the amount of such energy displacement is dependent on the diameter of the holes 33. The greater the diameter, the greater the amount of water displaced, and, hence, the more the barrier sidewall 20 or 22 is permitted to buckle. It has been found that a fill hole 33 diameter of about 3–4 inches, noted above, is optimum wherein sufficient buckling of the sidewalls 20, 22 is permitted for the purposes described below without permanent damage to the barrier 10 upon impact with a vehicle. In the presently preferred embodiment, when the intermediate section 30 buckles inwardly, a pivot point is created about which the upper section 32 can move in a generally downward direction. Consequently, the tire and/or bumper of the vehicle is impacted by the upper section 32 of barrier device 10 and urged downwardly, back toward the pavement or ground along which the vehicle was traveling. This substantially prevents the vehicle from vaulting over the top of the barrier 10 and entering the opposing lane of traffic. Despite such movement of the intermediate and upper sections 30, 32 in response to impact, the material from which barrier device 10 is constructed allows such sections 30, 32 to return to their original shape after deformation.

Resistance to Barrier Disengagement

Figure 4:
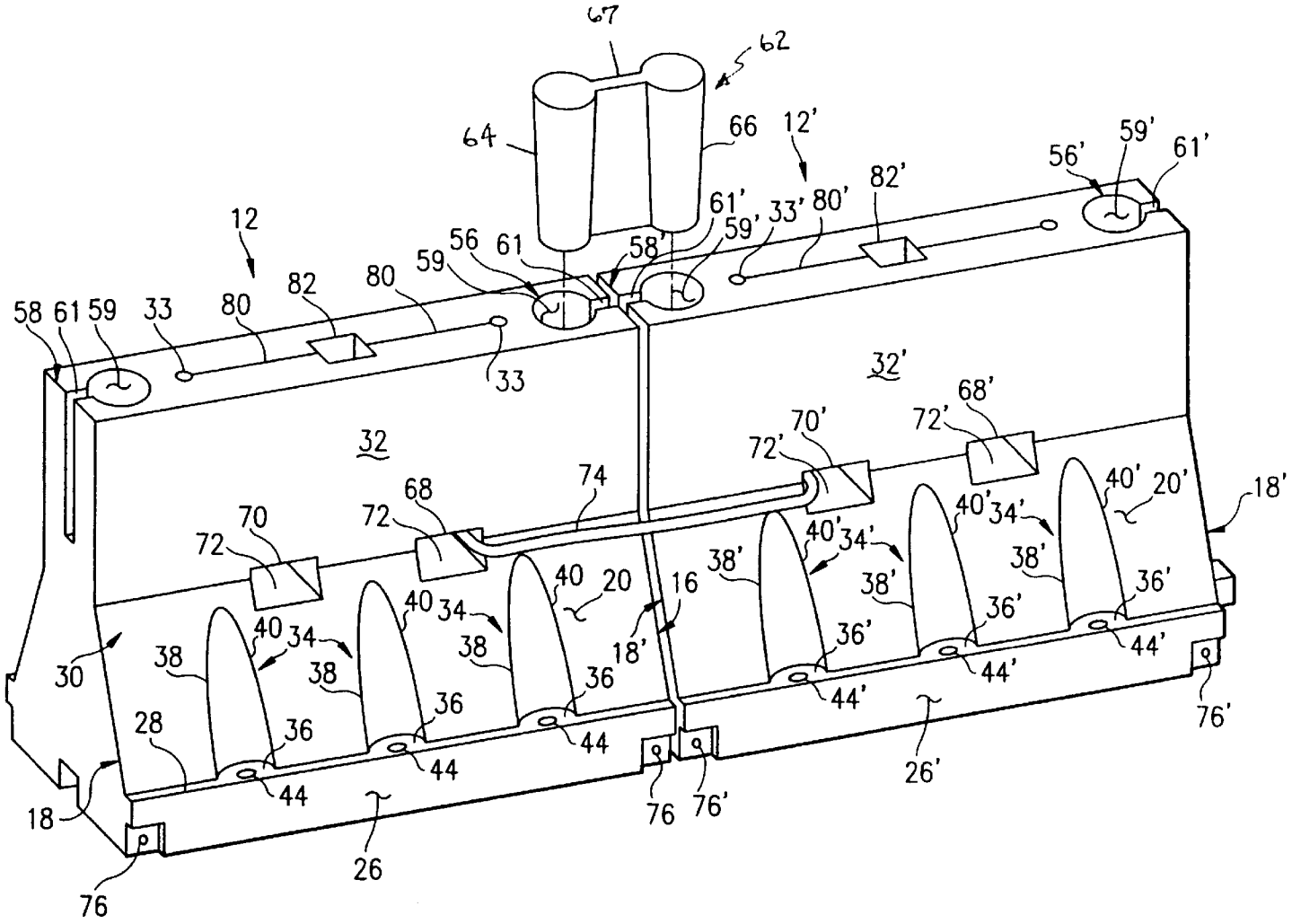
FIG. 4 is a perspective view of two barriers connected end-to-end.

Another general aspect of the construction of the barrier device 10 of this invention involves a number of elements designed to resist disengagement of adjacent barrier devices 10 and 10' when they are arranged end-to-end to form an essentially continuous wall. Two barrier devices 10 and 10' are depicted in FIG. 4, which are identical in structure and function. The same reference numbers are therefore used to identify like structure, with the addition of a "'" to the numbers associated with barrier 10' on the right-hand side of FIG. 4.

Each end wall 16 of barriers 10 is formed with an internally extending recess 48 near the bottom wall 14, which receives an outwardly protruding extension 52 formed on the end wall 18 of an adjacent barrier 10. The upper portion of end wall 16 is formed with a slot 56, and the upper portion of end wall 18 is formed with a slot 58. Each slot 56, 58 has an inner, generally cylindrical-shaped portion 59 and a narrower, substantially rectangular-shaped portion 61 at their respective end walls 16, 18. The slots 56, 58 extend from the top wall 12 downwardly to a point near the juncture of the upper section 32 and intermediate section 30.

Figure 2:
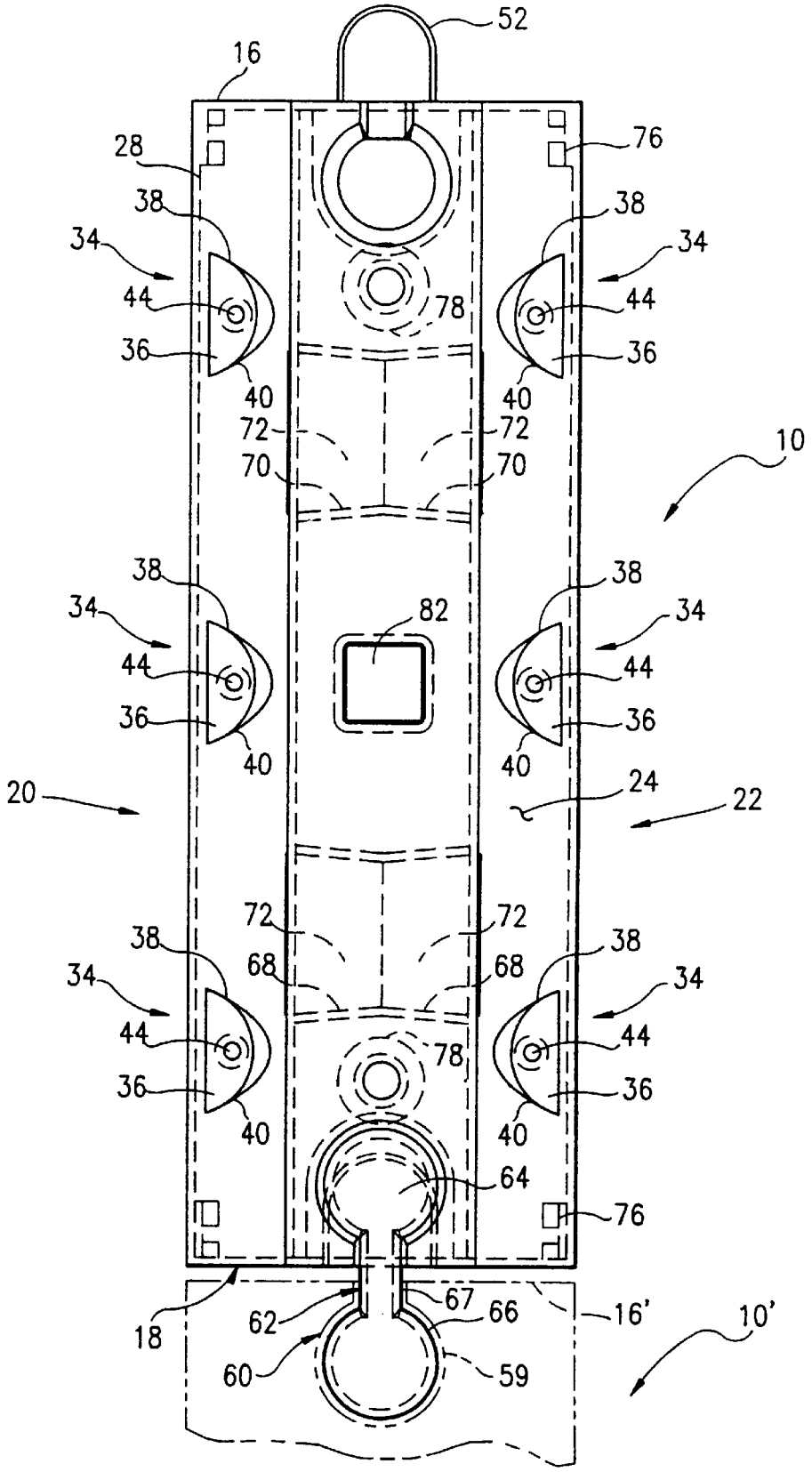
FIG. 2 is a plan view of the barrier depicted in FIG. 1, with a second barrier shown in phantom at one end.

When two barrier devices 10 and 10' are oriented end-to-end, with the end wall 16 of one barrier 10 abutting the end wall 18' of an adjacent barrier 10', the slots 56, 58 collectively form a barbell-shaped locking channel 60 shown in FIG. 4 and also depicted in phantom at the bottom of FIG. 2. This locking channel 60 receives a coupler 62 having cylindrical ends 64, 66 and a rectangular center section 67, which is removably insertable therein and extends substantially along the entire length of the locking channel 60. The cylindrical ends 64, 66 of coupler 62 pivot within the correspondingly shaped cylindrical portions 59, 59' of slots 56, 58', so that one barrier device 10 can be pivoted with respect to an adjacent barrier 10' to assist with alignment thereof, and to allow the barriers 10, 10' when placed end-to-end to follow curves along a particular highway or other location where they are placed.

Additionally, a pair of hollow sleeves 68 and 70 are located within the hollow interior 24 of barrier device 10 and extend between the sidewalls 20, 22. A portion of both sleeves 68, 70 is located in the intermediate section 30 of each sidewall 20, 22, and extends partially into the upper sections 32 thereof. The two sleeves 68, 70 are positioned in the spaces between the three stabilizers 34 formed in the sidewalls 20, 22, and provide added internal support to the barrier 10 so that it retains its shape when filled with a ballast material.

Each of the sleeves 68 and 70 define a pass-through hole or channel 72 adapted to receive the tines of a forklift truck to permit handling of the barriers 10. Moreover, a strap 74

(see FIG. 4) can be extended between the channel 72 of sleeve 68 in one barrier 10 and the channel 72 of sleeve 70' in an adjacent barrier 10', and then tightened down, to urge such barriers 10, 10' together and provide additional resistance to disengagement of adjacent barriers 10, 10'. It is believed that the combination of: (1) the extension 52—recess 48 connection; (2) the coupler 62 and locking channel 60 engagement; (3) the straps 74; and, (4) the stake(s) 46 or other anchoring device secured within the throughbores 44 noted above, collectively provides improved resistance to disengagement between adjacent barriers 10 compared to prior barrier designs.

Additional Features

In addition to the foregoing structural elements of the barrier device 10, a drain hole 76 is formed along each of the end walls 16 and 18 thereof near the bottom wall 14 to allow passage of water and the like from one side of the barrier device 10 to the other. Water or other flowable material is introduced into the hollow interior 24 of the barrier device 10 via the fill holes 33 formed in top wall 12. These fill holes 33 can also receive the post of a sign or the like (not shown) extendable into the barrier interior 24. As shown in FIG. 2, a post boot 78 is formed at the bottom wall 14 of barrier 10, in alignment with each fill hole 33, to receive and support the post of a sign inserted through the fill hole 33. Preferably, the top wall 12 is formed with an elongated channel 80 leading to each fill hole 33 to allow for the flow of rainwater into the hollow interior 24. The top wall 12 is also formed with an internally extending seat 82 which is adapted to mount an internal light fixture (not shown) for illuminating the barrier device 10 from the inside. The details of such lighting construction form no part of this invention and are thus not discussed herein.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. A barrier device comprising:

a bottom wall, a top wall, opposed sidewalls and opposed end walls interconnected to collectively define a hollow interior adapted to be at least partially filled with a selected material;

each of said sidewalls including:

(i) a substantially vertically extending curb reveal connected to said bottom wall;

(ii) a substantially vertically extending upper section connected to said top wall;

(iii) an angled intermediate section having a first end connected to said upper section and a second end; and (iv) a substantially horizontal step extending continuously from one end wall to the opposite end wall and being connected between said second end of said intermediate section and said curb reveal.

2. The barrier device of claim 1 in which said intermediate section of each sidewall is formed with a number of stabilizers, each of said stabilizers including a base and a pair of opposed sides, said sidewalls being formed with a throughbore extending from said base of each stabilizer through said bottom wall, at least one of said throughbores receiving an anchoring device adapted to be driven into the surface upon which said bottom wall rests.

3. The barrier device of claim 1 further including a pair of hollow sleeves extending between said opposed sidewalls at the juncture of said intermediate section and said upper section of each said sidewalls, each of said sleeves defining a pass-through hole adapted to receive the tine of a fork-lift truck.

4. The barrier device of claim 3 further including a strap extendable within said hollow sleeve of one barrier device and within the hollow sleeve of an adjacent barrier device, said strap being capable of being tightened to urge said adjacent barrier devices together end-to-end.

5. The barrier device of claim 1 in which one of said end walls is formed with a recess extending vertically upwardly from said bottom wall to a location along said end wall approximately equal to the height of said curb reveal and the other of said end walls is formed with an extension mateable with said recess.

6. The barrier device of claim 1 in which each of said end walls, and a portion of said top wall, is formed with a slot, said slot of one end wall of a first barrier being alignable with and substantially parallel to the slot of an end wall of a second barrier when said first and second barriers are positioned end-to-end, said barrier device further including a coupler insertable within said aligning slots to interconnect said first and second barriers so that said first barrier is pivotal with respect to said second barrier.

7. The barrier device of claim 1 in which said top wall is formed with at least one inlet extending into said hollow interior for filling said hollow interior with a flowable material, said top wall being formed with a channel extending along at least a portion of the length thereof for directing water falling thereon into said inlet.

8. The barrier device of claim 1 in which said top wall is formed with at least one inlet, said barrier device further including a post boot mounted to said bottom wall within said hollow interior and in alignment with said at least one inlet, said at least one inlet and said post boot being adapted to receive and support the post of a sign.

9. The barrier device of claim 1 in which said hollow interior is formed with internal drain channels extending between said curb reveals of said opposed sidewalls to permit the passage of water from the exterior of one side of said barrier to the exterior of the opposite side of said barrier.

10. A barrier device comprising:

a bottom wall, a top wall, opposed sidewalls and opposed end walls interconnected to collectively define a hollow interior adapted to be at least partially filled with a selected material;

each of said sidewalls including a substantially vertically extending curb reveal connected to said bottom wall, a substantially vertically extending upper section connected to said top wall, an angled intermediate section connected at one end to said upper section, and, a substantially horizontally extending step connected between the other end of said intermediate section and said curb reveal;

said intermediate section of each of said sidewalls being formed with a number of stabilizers, each of said stabilizers including a base and a pair of opposed sides, said sidewalls being formed with a throughbore extending from said base of each stabilizer and through said bottom wall, at least one of said throughbores receiving an anchoring device adapted to be driven into the surface upon which said bottom wall rests.

11. The barrier device of claim 10 in which said base of each stabilizer is coplanar with said step of said sidewalls.

12. A barrier device comprising:

a bottom wall, a top wall, opposed sidewalls and opposed end walls interconnected to collectively define a hollow interior adapted to be at least partially filled with a selected material;

each of said sidewalls including.

(i) a substantially vertically extending curb reveal connected to said bottom wall;

(ii) a substantially vertically extending upper section connected to said top wall;

(iii) an angled intermediate section having a first end connected to said upper section and a second end, and (iv) a substantially horizontal step extending continuously from one end wall to the opposite end wall and being connected between said second end of said intermediate section and said curb reveal;

a pair of spaced, hollow sleeves located within said hollow interior and extending between said opposed sidewalls at the juncture of said intermediate section and said upper section of each of said sidewalls, each of said hollow sleeves defining a pass-through hole adapted to receive the tine of a fork lift truck.

13. The barrier device of claim 12 further including a strap extendable through said pass-through hole and being adapted to attach within said pass through hole of another barrier.

14. An apparatus for forming a barrier wall comprising:

a number of individual barrier devices, each of said barrier devices including:

(i) a bottom wall, a top wall, opposed sidewalls and opposed end walls interconnected to collectively define a hollow interior adapted to be at least partially filled with a selected material;

(ii) each of said sidewalls including a substantially vertically extending curb reveal connected to said bottom wall, a substantially vertically extending upper section connected to said top wall, an angled intermediate section having a first end connected to said upper section and a second end, and, a substantially horizontally extending step extending continuously from one end wall to the opposite end wall and being connected between said second end of said intermediate section and said curb reveal;

one of said end walls of each barrier device being formed with a recess extending vertically upwardly from said bottom wall along a portion of said one end wall, and the other of said end walls being formed with an extension mateable with said recess whereby said extension of one barrier device can be connected to the recess of an adjacent barrier device.

15. An apparatus for forming a barrier wall comprising:

a number of individual barrier devices, each of said barrier devices including:

(i) a bottom wall, a top wall, opposed sidewalls and opposed end walls interconnected to collectively define a hollow interior adapted to be at least partially filled with a selected material;

(ii) each of said sidewalls including a substantially vertically extending curb reveal connected to said bottom wall, a substantially vertically extending upper section connected to said top wall, an angled intermediate section having a first end connected to said upper section and a second end, and, a substantially horizontally extending step extending continuously from one end wall to the opposite end wall and being connected between said second end of said intermediate section and said curb reveal;

said end walls of each barrier device, and a portion of said top wall thereof, being formed with a slot, said slot in one end wall of one barrier device being alignable with and substantially parallel to the slot in an end wall of an adjacent barrier device to form a locking channel when said barrier devices are oriented end-to-end;

a coupler insertable within said locking channel to interconnect and permit pivotal movement between said adjacent barrier devices.

* * * * *